US010349696B2

(12) United States Patent
Ogata

(10) Patent No.: US 10,349,696 B2
(45) Date of Patent: Jul. 16, 2019

(54) FOOTBALL HELMET

(71) Applicant: Kenneth K. Ogata, Huntington Beach, CA (US)

(72) Inventor: Kenneth K. Ogata, Huntington Beach, CA (US)

( * ) Notice: Subject to any disclaimer, the term of this patent is extended or adjusted under 35 U.S.C. 154(b) by 0 days.

(21) Appl. No.: 15/661,985

(22) Filed: Jul. 27, 2017

(65) Prior Publication Data

US 2019/0029353 A1 Jan. 31, 2019

(51) Int. Cl.

| | |
|---|---|
| ***A42B 3/06*** | (2006.01) |
| ***A42B 3/12*** | (2006.01) |
| ***A42B 3/28*** | (2006.01) |
| ***A63B 71/10*** | (2006.01) |

(52) U.S. Cl.

CPC ..... *A42B 3/062* (2013.01); *A42B 3/06* (2013.01); *A42B 3/063* (2013.01); *A42B 3/125* (2013.01); *A42B 3/283* (2013.01); *A63B 71/10* (2013.01)

(58) Field of Classification Search

CPC .. A42B 3/062; A42B 3/06; A42B 3/63; A42B 3/069; A42B 3/12

USPC ..... 2/6.8, 411, 414, 425

See application file for complete search history.

(56) References Cited

U.S. PATENT DOCUMENTS

| | | | | |
|---|---|---|---|---|
| 2,306,362 A | | 12/1938 | Wolff | |
| 2,629,095 A | | 1/1948 | Kleinman | |
| 4,012,794 A | * | 3/1977 | Nomiyama | A42B 3/064 2/411 |
| 4,223,409 A | | 9/1980 | Lee | |
| 4,307,471 A | | 12/1981 | Lovell | |
| 4,472,472 A | | 9/1984 | Schultz | |
| 5,101,517 A | * | 4/1992 | Douglas | A42B 3/20 2/424 |
| 6,378,140 B1 | | 4/2002 | Abraham et al. | |
| 6,385,781 B1 | | 5/2002 | Rose et al. | |
| 2004/0168246 A1 | | 9/2004 | Phillips | |
| 2006/0059606 A1 | * | 3/2006 | Ferrara | A01N 25/18 2/412 |
| 2012/0198604 A1 | | 8/2012 | Weber et al. | |
| 2012/0233745 A1 | * | 9/2012 | Veazie | A42B 3/121 2/413 |
| 2012/0297526 A1 | * | 11/2012 | Leon | A42B 3/12 2/413 |
| 2013/0061373 A1 | * | 3/2013 | Cleva | A42B 1/08 2/413 |
| 2013/0185837 A1 | | 7/2013 | Phipps et al. | |

(Continued)

*Primary Examiner* — Alissa J Tompkins
*Assistant Examiner* — Cameron A Carter
(74) *Attorney, Agent, or Firm* — Carr & Ferrell LLP

(57) ABSTRACT

A helmet having an inner shell with a first projection and a second projection, an outer shell, and at least one shock absorption system. Each shock absorption system comprises a first recess disposed in the first projection, a second recess disposed in the second projection, and a leaf spring having a first leg, a second leg, and a curved middle portion. The first leg is received by the first recess and the second leg is received by the second recess. The leaf spring is adapted to flex and extend into the first and second recesses in response to an external impact to the helmet. The inner shell and outer shell may be composed of a synthetic fiber. The shock absorption system may also include a compression spring disposed between a flange of the leaf spring and the second projection of the inner shell.

19 Claims, 10 Drawing Sheets

(56) References Cited

U.S. PATENT DOCUMENTS

| | | | | |
|---|---|---|---|---|
| 2013/0340146 | A1* | 12/2013 | Dekker | A42B 3/125 2/411 |
| 2013/0340149 | A1* | 12/2013 | Richwine | A42B 3/20 2/422 |
| 2014/0173810 | A1* | 6/2014 | Suddaby | A42B 3/124 2/413 |
| 2014/0325745 | A1* | 11/2014 | Erb | A42B 3/127 2/414 |
| 2015/0107005 | A1 | 4/2015 | Schneider | |
| 2015/0143617 | A1* | 5/2015 | Suddaby | A42B 3/064 2/414 |
| 2015/0164172 | A1* | 6/2015 | Linares | A42B 3/065 2/411 |
| 2015/0167768 | A1 | 6/2015 | Zhao | |
| 2015/0264993 | A1* | 9/2015 | Vito | A42B 3/125 2/414 |
| 2015/0285697 | A1 | 10/2015 | O'Bier et al. | |
| 2016/0015111 | A1* | 1/2016 | Latruffe | A42B 3/06 2/412 |
| 2016/0021965 | A1* | 1/2016 | Mayerovitch | A42B 3/12 2/414 |
| 2016/0029731 | A1* | 2/2016 | Magee | A42B 3/069 2/412 |
| 2016/0073723 | A1* | 3/2016 | Halldin | A42B 3/064 2/411 |
| 2016/0088884 | A1* | 3/2016 | Guerra | A42B 3/064 2/411 |
| 2016/0157545 | A1* | 6/2016 | Bowman | A42B 3/067 2/416 |
| 2017/0027267 | A1* | 2/2017 | Morgan | A42B 3/062 |

* cited by examiner

FOOTBALL HELMET

TECHNICAL FIELD

The subject disclosure generally relates to protective headgear, and in particular, to football helmets that reduce shock of impact.

BACKGROUND

Various types of protective headgear are known. Protective headgear is generally used by users operating certain types of vehicles, such as motorcycles or bicycles, or by players of various sports, namely American football. Concussions and other types of brain damage are a serious problem for players in such sports, which result from high impact forces to the head during play. More serious brain injury may further result from repetitive concussions and brain damage. Consequently, individuals exposed to repeated impacts to the head have a need for protective headgear that dramatically reduces the shock of impact and reduces the likelihood of concussion. Furthermore, many American football leagues, such as the National Football League, prevent players from returning to a game after experiencing a concussion from such impacts. Thus, such impacts affect both the players' health and career. In addition, many players are also injured as a result of being impacted by traditional helmets.

Shock proof helmets for preventing brain damage and concussion have been long sought after. Various helmets exist to reduce the shock of impact, such as those having various cushions that absorb impact energy. However, traditional helmets generally do not effectively deflect and absorb impact forces away from user's head such as to prevent concussion.

Accordingly, there is a need for the development of a helmet which effectively protects the user from concussion and other brain damage.

SUMMARY

A protective football helmet is provided to absorb impact from external forces. The helmet includes an inner layer or shell, an outer layer or shell, and an internal air space. The inner shell may be composed of a synthetic fiber such as Kevlar® and dense foam, and the outer layer may be composed of an aluminum or carbon fiber. In various embodiments, air vents are disposed in a lower portion of the outer shell. A leaf or arc spring is disposed between the inner and outer shells within the internal air space. A first and a second end of the leaf spring are coupled to the inner shell, and a middle portion of the leaf spring rests abutting against an inner surface of the outer shell. As such, when the outer layer of the football helmet is impacted, the force is distributed through the leaf spring, and outward in a direction tangential to the inner shell. Thus, the direction of the impact is distributed away from the user's head.

In a further embodiment, the leaf springs are coupled to a compression spring at a second end. The compression spring facilitates further distributing the impact against the helmet by distributing the force to both the inner shell at a point of attachment between the leaf spring and the inner shell, and an internally disposed compression spring. In addition, other embodiments include two compression springs per leaf spring (one disposed at either end of the leaf spring) and having a removable or replaceable outer layer or shell.

According to some embodiments, the present disclosure is directed to a helmet comprising an inner shell having a first projection and a second projection, an outer shell coupled to the inner shell, and at least one shock absorption system disposed between the inner shell and the outer shell. Each shock absorption system comprises a first recess disposed in the first projection, a second recess disposed in the second projection, and a leaf spring having a first leg, a second leg, and a curved middle portion. The first recess has a first opening and a first inner wall, and extends from the first opening to the first inner wall tangentially to a curvature of the inner shell. The second recess has a second opening and a second inner wall, and extends from the second opening to the second inner wall tangentially to a curvature of the inner shell. The first leg of the leaf spring is received by the first recess and the second leg is received by the second recess. The leaf spring is adapted to flex and extend into the first and second recesses in response to an external impact to the helmet.

According to one or more embodiments, the inner shell is composed of a synthetic fiber, such as Kevlar®, and the outer shell is composed of carbon fiber. The shock absorption system may also include a compression spring disposed between a flange of the leaf spring and the second projection of the inner shell.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
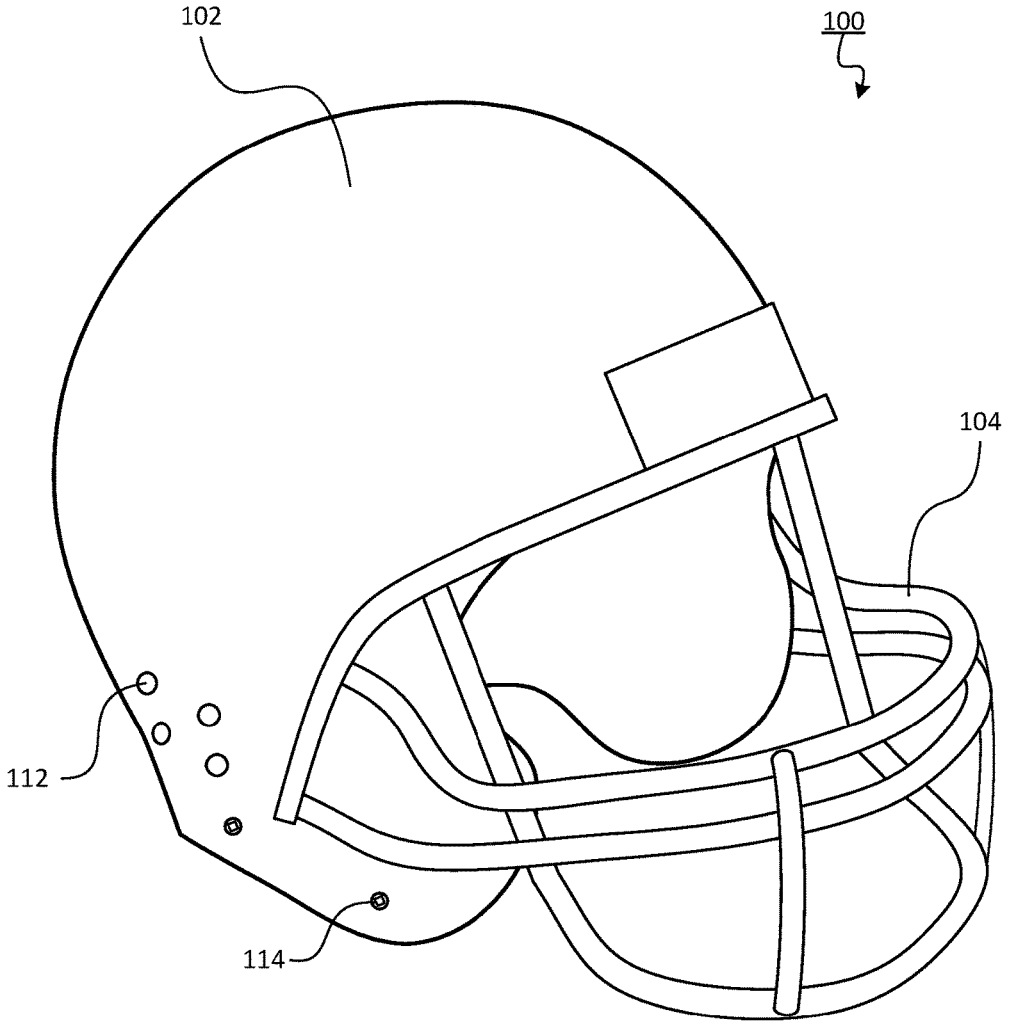
FIG. 1 illustrates an exemplary football helmet according to the subject disclosure.
Figure 2:
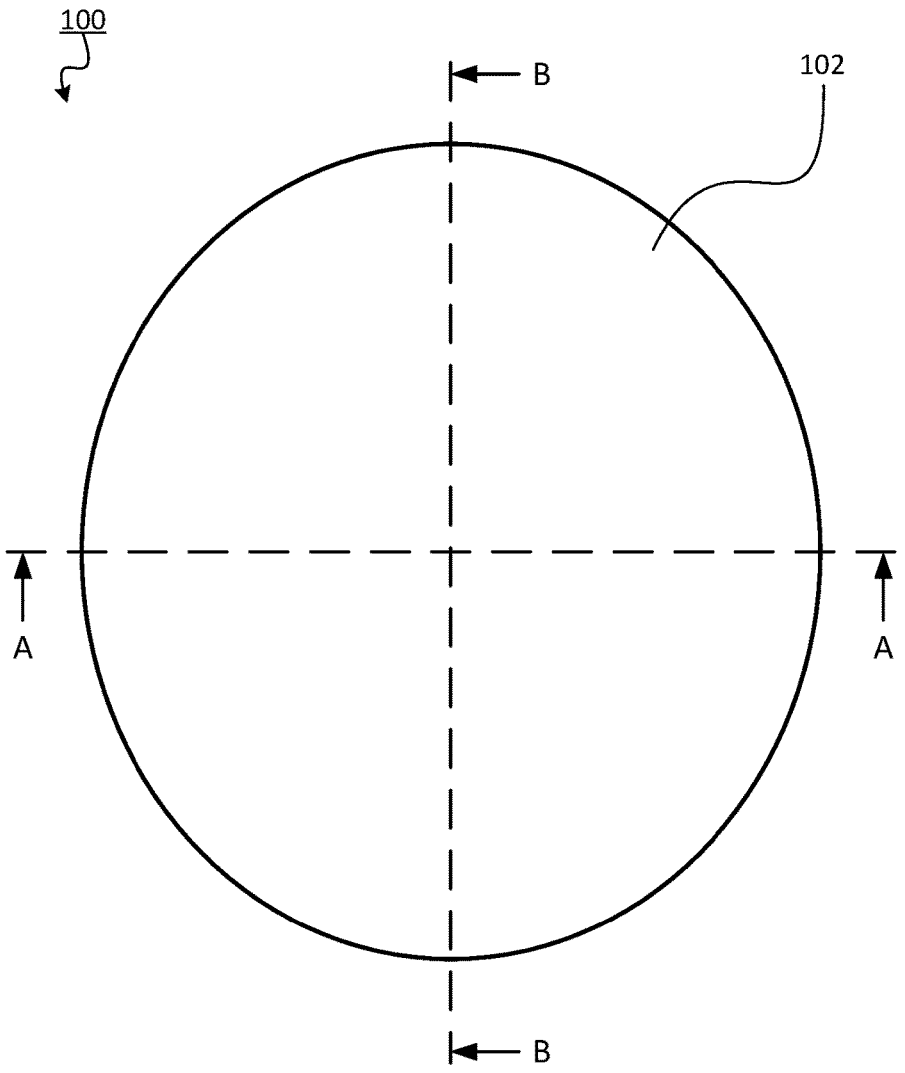
FIG. 2 shows a top view of the exemplary football helmet, without the face mask for ease of illustration, according to the subject disclosure.

FIGS. 1 and 2 show a perspective view and top view of an exemplary football helmet 100. The football helmet 100 includes a protective shell 102 and face mask 104. The football helmet 100 is conducive to absorb and reduce shock due to impact forces and prevent brain damage to concussion to the user.

Figure 3:
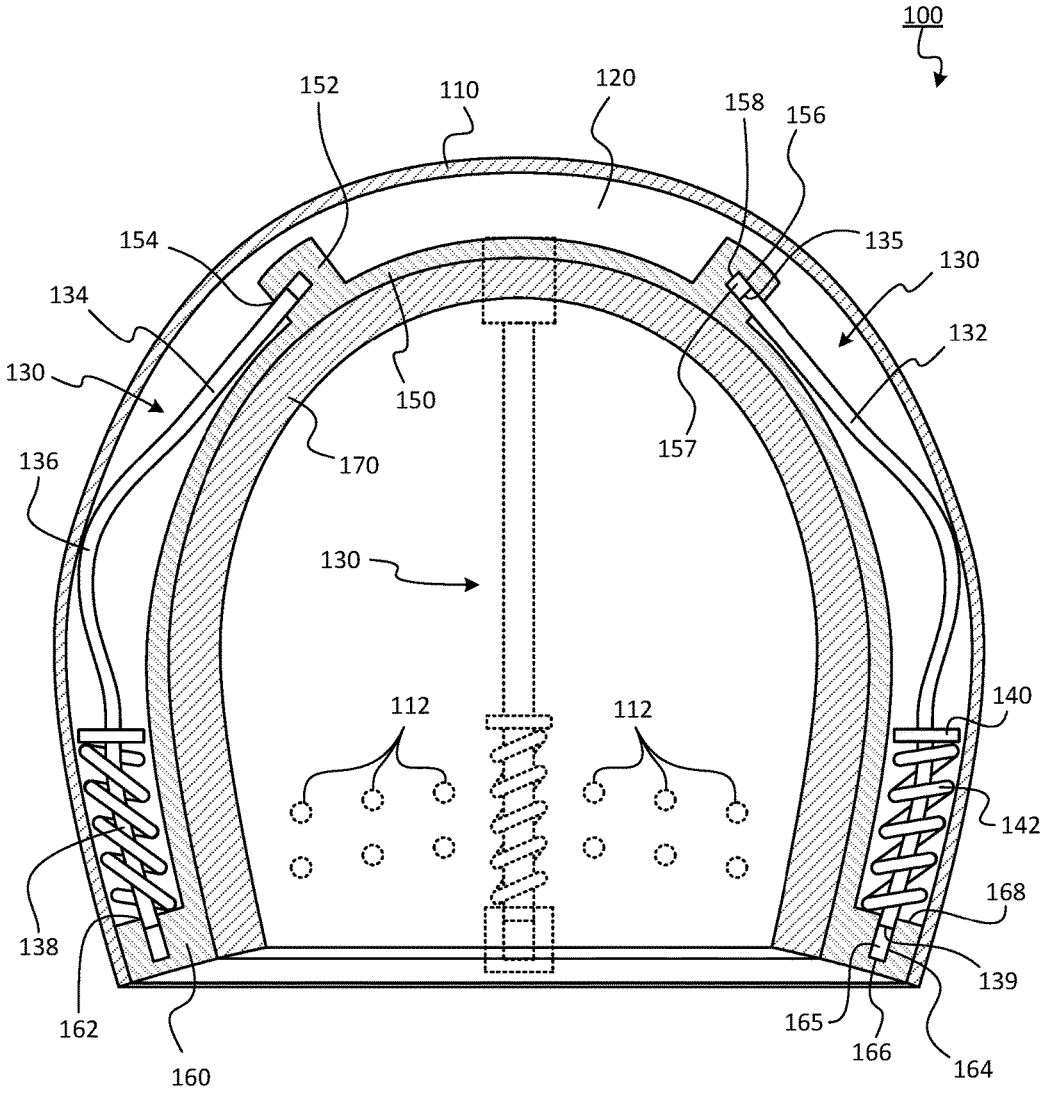
FIG. 3 depicts a front cross section view of the exemplary football helmet about A-A in FIG. 2, according to the subject disclosure.

FIG. 3 depicts a front cross section view of the football helmet 100 about A-A in FIG. 2. The football helmet 100 includes an outer shell 110, an internal air space 120, shock absorption systems 130, an inner shell 150, and padding 170. The shock absorption systems 130 are disposed between the inner shell 150 and the outer shell 110. The shock absorption systems 130 are not shown in cross section for ease of illustration and will be described in greater detail with reference to FIG. 4. It is to be understood that, while there are three shock absorption systems 130 shown in FIG. 3, any suitable number and arrangement of shock absorption systems 130 may be provided.

The outer shell 110 is securely coupled to the inner shell 150 via any suitable fastener 114 (as shown in FIG. 1), such as a screw, bolt and nut, clamp, rivet, or any other suitable fastener to secure the outer shell 110 to the inner shell 150. For example, the fasteners may secure a lower portion of the outer shell 110 to a second projection 160 of the inner shell 150. In various embodiments, the outer shell 110 is a thin shell constructed from or composed of a material with a high strength to weight ratio, such as an aluminum, carbon fiber, or polycarbonate. Furthermore, the fasteners 114 may be completely flush with a smooth outer surface of the outer shell 110. The smooth outer surface of the outer shell 110 may be completely smooth and continuous aside for air vents 112, which is advantageous to prevent opposing players from gripping the football helmet 100.

The outer shell 110 is coupled to the inner shell 150 such that the outer shell 110 is replaceable. For example, if the outer shell 110 is damaged upon impact, a user may replace the damaged outer shell 110 from the football helmet 100 by removing the fasteners, separating the damaged outer shell 110, installing a new outer shell 110, and replacing the fasteners. Advantageously, the shock absorption systems 130, the inner shell 150, and the padding 170, which may have more durability than the outer shell 110, are re-usable.

In various embodiments, air vents 112 are disposed within the outer shell 110. The air vents 112 are in fluid communication between an external environment and the internal air space 120 disposed between the inner shell 150 and the outer shell 110. An impact to the outer shell 110 will force air within the internal air space 120 out of the air vents 112. In other words, the air vents 112 create an air cushion effect, whereby a portion of the impact energy will be released by compressing the air and releasing a portion of the air out through the air vents 112. While the air vents 112 are shown as circular and arranged in two lateral rows, it is to be understood that the air vents 112 may be constructed of a variety of different sizes, shapes, and/or arrangements suitable to provide an air cushion upon impact. Furthermore, while the air vents 112 are shown as being disposed on a lower portion of the outer shell 110, in other embodiments the air vents may be disposed on any portion of the outer shell 110.

The inner shell 150 provides structural support to the outer shell 110, the shock absorption systems 130, and the padding 170. The inner shell 150 includes a first projection 152 and a second projection 160. In some embodiments, the first and second projections 152, 160 are co-molded with the inner shell 150 such that the first and second projections 152, 160 are constructed from the same material composition, such as a synthetic fiber like Kevlar®, carbon fiber, or other suitable light weight, durable material. Alternatively, the first and second projections 152, 160 may be coupled to the inner shell 150 with a suitable fastener. As shown in FIG. 3, the second projection 160 is constructed as a flange that outwardly extends from a lower edge of the inner shell 150.

The padding 170 provides additional protection against impact forces. The padding 170 is provided on an inner surface of the inner shell 150 and may have a predetermined thickness. In various embodiments, the padding 170 includes dense foam such as polypropylene, ethylene-vinyl acetate, or other suitable foam. The padding 170 may also comprise multiple types of foam in varying arrangements as to further absorb impact energy and provide comfort to the user.

Figure 4:
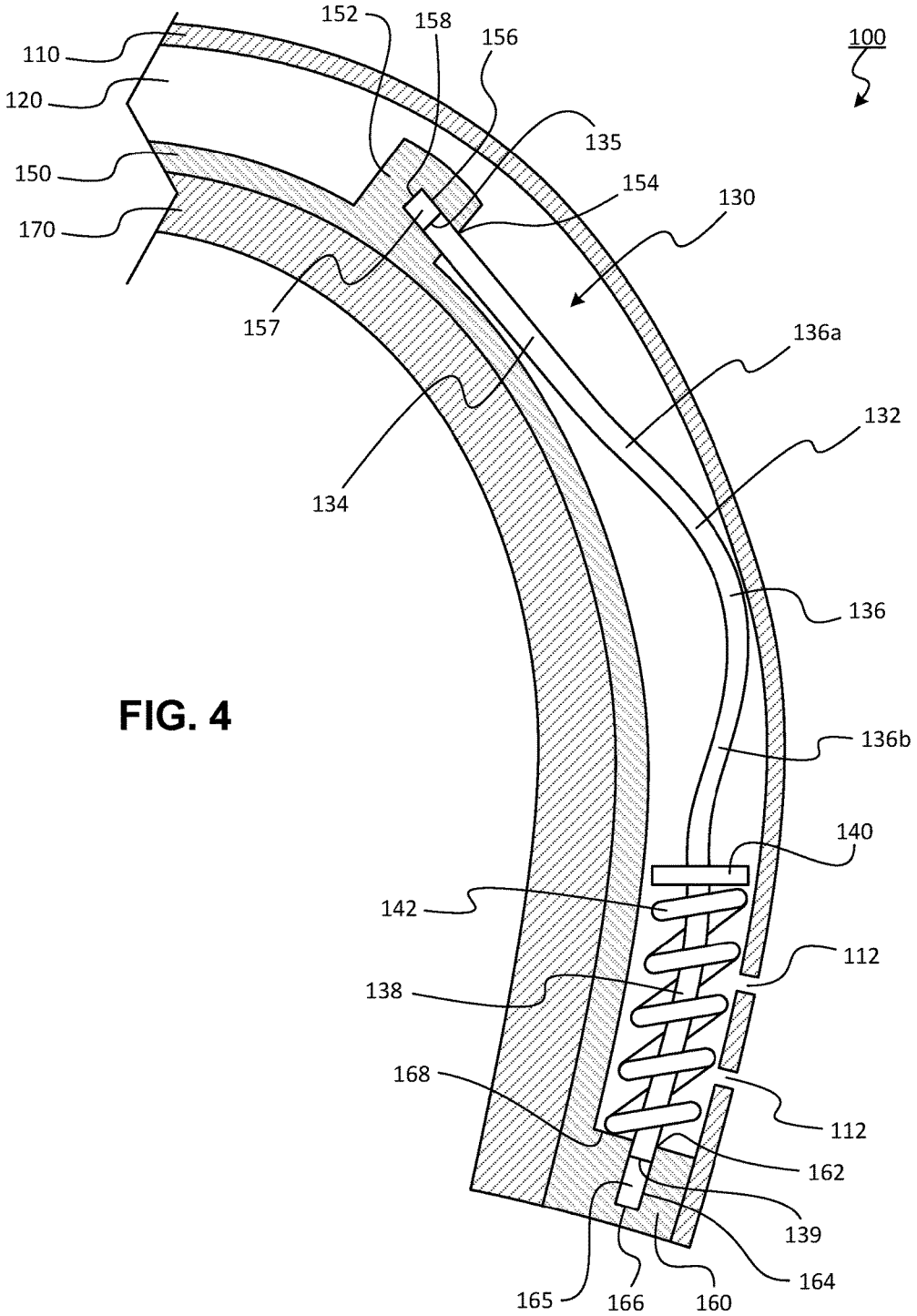
FIG. 4 illustrates a partial right side cross section view of the exemplary football helmet about B-B in FIG. 2, according to the subject disclosure.

As shown in greater detail in FIG. 4, each shock absorption system 130 comprises a leaf spring 132 and a compression spring 142. The leaf spring 132 may also be referred to as an arc spring or flexible spring. The leaf spring 132 is generally formed as an elongated member having a first portion 134, a middle portion 136, and a second portion 138, further including a flange 140. The elongated member may have a substantially constant thickness along a curved length. The first and second portions 134, 138 are slightly curved to match a curvature of the outer shell 110 and the inner shell 150, though it is to be understood that the first and second portions 134, 138 may also be flat. The first and second portions 134, 138 may also be referred to as legs, and the middle portion 136 may be referred to as an arc or curved middle portion. The leaf spring 132 may be steel, or may otherwise be constructed from carbon fiber or other suitable metal, composite, plastic, etc. for storing elastic energy upon collapsing or deformation.

In various embodiments, the leaf spring 132 is arranged vertically within the internal air space 120. For example, the leaf spring 132 extends from the second portion 138 proximate a head opening of the football helmet 100, to the first portion 134 proximate an apex of the football helmet 100. Referring back to FIG. 3, multiple shock absorption systems 130 may be arranged concentrically around the internal air space 120 such that each leaf spring 132 is a longitudinal or rib-like member.

As shown in FIG. 4, the middle portion 136 comprises a predetermined curvature in a default state spanning between a first and a second inflection point 136*a*, 136*b*. A convex surface of the middle portion 136 faces and abuts against an inner surface of the outer shell 110. Upon impact to the football helmet 100, the impact forces will transfer through the outer shell 110 and apply an external force to the convex surface of the middle portion. Energy from the impact will transfer into the leaf spring 132 as the middle portion 136 is substantially flattened, as will be described in greater detail with respect to FIGS. 5-7.

The first and second portions 134, 138 have a first and a second end 135, 139, respectively, disposed at distal portions thereof (also referred to as a first and a second distal end). In a default state, the first end 135 of the first portion 134 is slidingly received by a first recess 156 of the first projection 152. That is, an opening 154 of the first recess 156 is adapted to receive the first end 135 such that the leaf spring 132 may linearly slide in and out of the first projection 152 along a dimension roughly tangential to the inner shell 150. The first recess 156 extends into the first projection 152 tangentially to the inner shell 150. In other words, a plane comprising the opening 154 is orthogonal to the outer surface of the inner shell 150 as shown in the various cross section views. In a default state shown in FIG. 4, a gap 157 is disposed between the first end 135 and an inner-most wall 158 of the first recess 156.

Similarly, in a default state, the second end 139 of the second portion 138 is slidingly received by a second recess 164 of the second projection 160. An opening 162 of the second recess 164 is adapted to receive the second end 139 such that the leaf spring 132 may linearly slide in and out of the second projection 160 along another dimension that is also roughly tangential to the inner shell 150. The second recess 164 extends into the second projection 160 tangentially to the inner shell 150. In other words, a plane comprising the opening 162 is orthogonal to the outer surface of the inner shell 150 as shown in the various cross section views. Furthermore, in the default state, a gap 165 is disposed between the second end 139 and an inner-most wall 166 of the second recess 164. The first and second projections 152, 160 may be considered a part of the shock absorption system 130.

In one or more embodiments, the first and second recess 156, 164 receive and secure the first and second ends 135, 139 by a friction fit. The force of an impact on the football helmet 100 will bend the middle portion 136 and extend the first and second ends 135, 139 in a direction away from the middle portion 136. The friction fit is loose enough to allow the first and second ends 135, 139 to slide along the first and second recesses 156, 164, respectively, but great enough to prevent the leaf spring from becoming dislodged from the inner shell 150.

FIG. 4 further illustrates the compression spring 142 being coupled to, or concentrically disposed around, the second portion 138 of the leaf spring 132. The compression spring 142 may also be referred to as a shock spring herein. The compression spring 142 rests abuttingly between the flange 140 of the leaf spring 132 and a flat portion 168 of the second projection 160. In the default state, the compression spring 142 is not compressed, and thus applies little to no force against the flange 140 and flat portion 168.

The flange 140 extends radially outward from the leaf spring 132 in a direction generally normal to a tangential of the curvature of the leaf spring 132. It is to be understood that the flange 140 may comprise any shape or size suitable to compress the compression spring 142 upon impact. Furthermore, while shown in FIG. 4 as being co-molded into the leaf spring 132, the flange 140 may also be coupled to the leaf spring 132 by any suitable fastener, weld, bond, etc.

Figure 5:
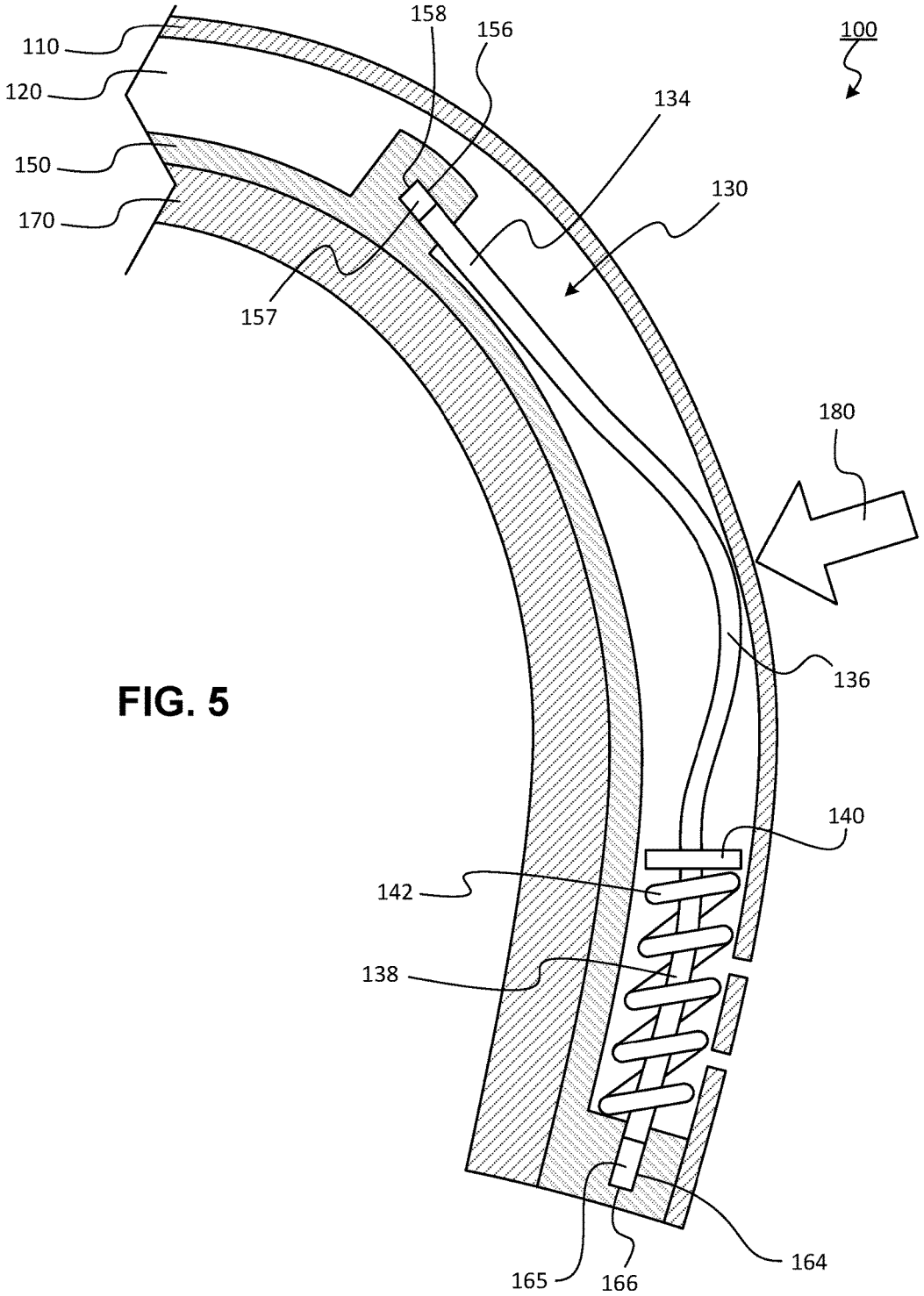
FIGS. 5-7 show a leaf spring of the exemplary football helmet absorbing energy from an impact, according to the subject disclosure.
Figure 6:
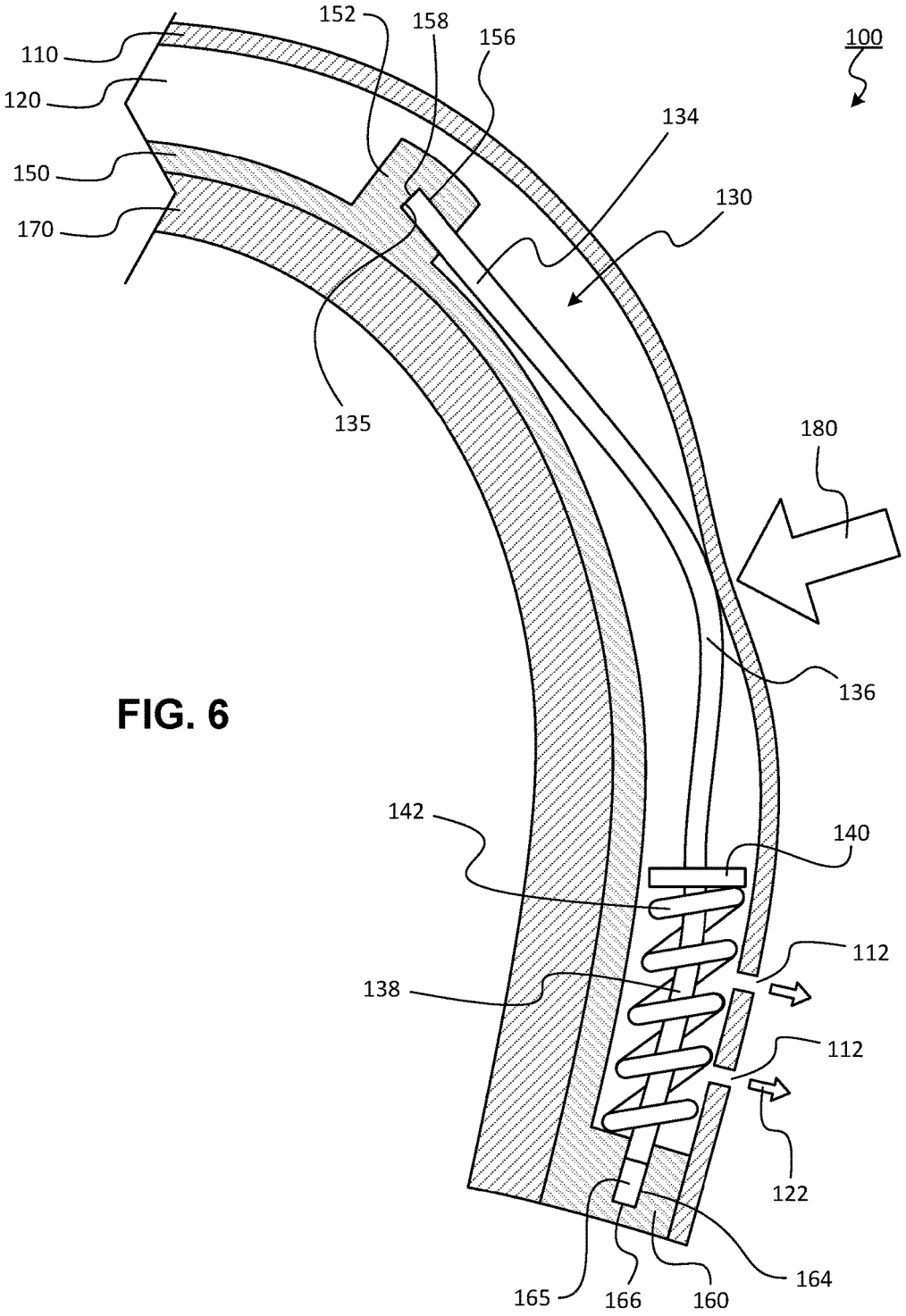
Figure 7:
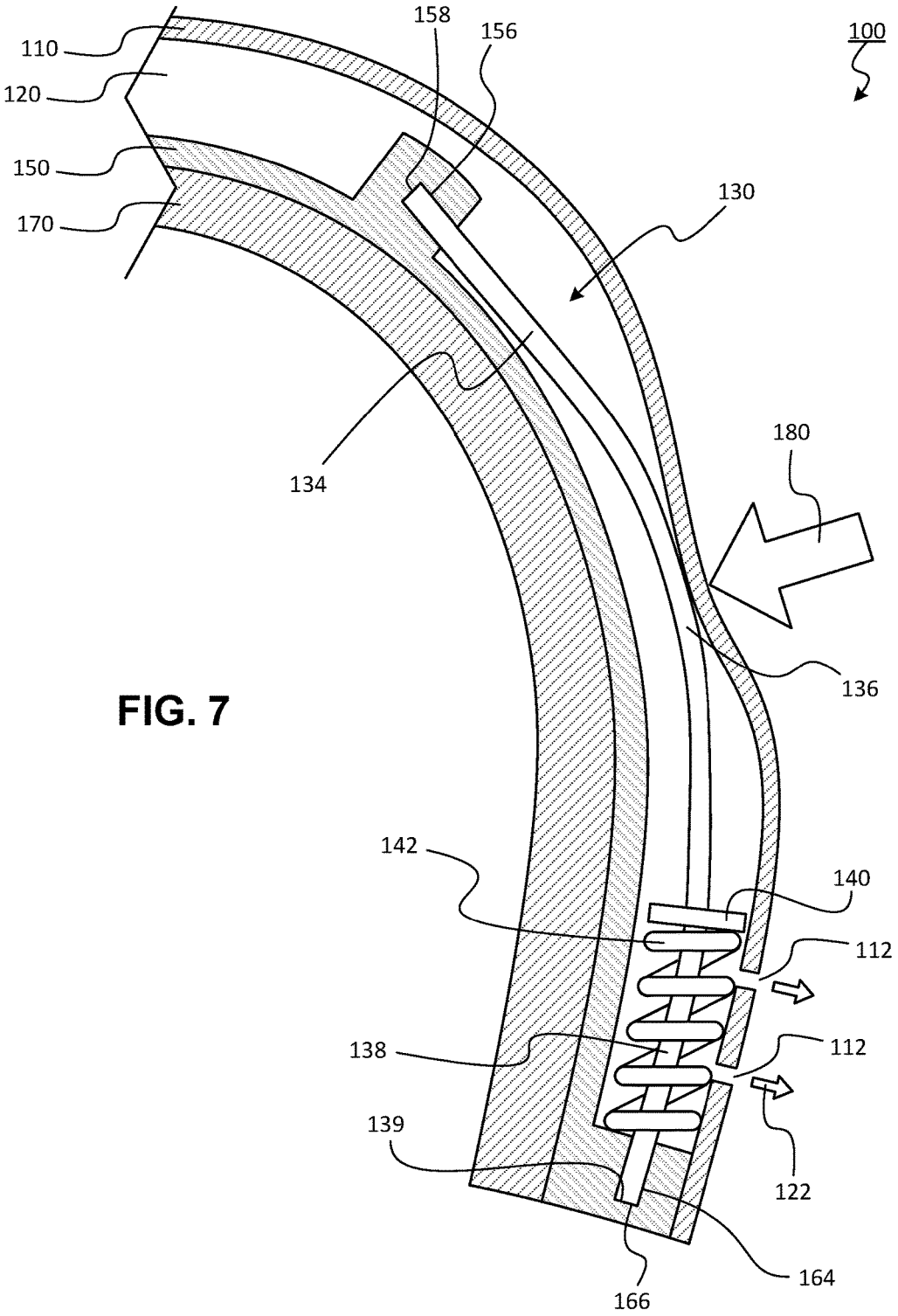

FIGS. 5-7 show the dissipation and absorption of energy from an external impact 180 applied to the football helmet 100. As such, a method of preventing injury to a user's head upon an external impact is exemplified. FIG. 5 shows the default state of the shock absorption system 130 immediately prior to the external impact 180. In the default state, the middle portion 136 retains the predetermined curvature. Furthermore, the first and second portions 134, 138 are slidingly received by the first and second recesses 156, 164 such that gaps 157, 165 are disposed between the first and second ends 135, 139 and the inner-most walls 158, 166, respectively. Additionally, the compression spring 142 is in a relaxed, non-compressed state.

FIG. 6 shows a first state, or active state, of the football helmet 100 due to the external impact 180. In response to the external impact 180, the outer shell 110 begins to deform and flex at the site of impact. The outer shell 110 abuts against the convex surface of the leaf spring 132, and distributes the impact force internally within the leaf spring 132 as well as outward towards the first and second ends 135, 139. As shown, the middle portion 136 bends such that the curvature is flatter than the predetermined curvature. As such, a portion of energy from the external impact 180 is stored within the leaf spring 132. Furthermore, it is to be understood that depicted deformations may be over exaggerated for purposes of description.

As the middle portion 136 is flattened, the first and second portions 134, 138 extend outwardly towards the first and second projections 152, 160, respectively. At the first state, the first end 135 abuts up against the inner-most wall 158 of the first recess 156. Thus, a portion of the external impact 180 is distributed to the first projection 152 of the inner shell 150.

As the second portion 138 moves towards the second projection 160, the flange 140 compresses the compression spring 142. Furthermore, the second end 139 extends further into the second recess 164, but not enough to close the gap 165 and reach the inner-most wall 166. In one embodiment, when the compression spring 142 is completely compressed, the second end 139 is even further extended into the second recess 164 but likewise is not extended enough to close the gap 165. In another embodiment, a length of the second recess 164 is adapted to fully receive the second end 139 when the compression spring 142 is completely compressed. In other words, the second end 139 abuts the inner-most wall 166. In a further embodiment, the compression spring 142 is only partially compressed when the second end 139 abuts the inner-most wall 166.

Furthermore, due to the external impact 180, a volume of the internal air space 120 is decreased as the outer shell 110 flexes. As a result, a portion of the energy from the external impact 180 is used in compressing the air within the internal air space 120. Another portion of the energy is dissipated during exhaust of the air 122 through the air vents 112.

FIG. 7 illustrates a second state, or another active state, of the shock absorption system 130. As shown, the leaf spring 132 at almost maximum deformation has a curvature that approximates the curvature of the inner shell 150 and outer shell 110. As the middle portion 136 is further flattened, the second portion 138 continues to extend outwardly towards the second projection 160. At the second state, the second end 139 abuts up against the inner-most wall 166 of the second recess 164. Thus, a portion of the external impact 180 is distributed to the second projection 160 of the inner shell 150.

Furthermore, the compression spring 142 is further compressed by the flange 140 and absorbs an even larger portion of energy from the external impact 180. In addition, since the volume of the internal air space 120 is further decreased, more energy is dissipated by the compression of the air and exhaust of air 122 from the air vents 112. Also, while not shown, the padding 170 is additionally being compressed between the inner shell 150 and the head of the user which absorbs further energy. Thus, shock from the external impact 180 is effectively absorbed and dissipated away from the user's head using the light-weight, inexpensive to manufacture, exemplary football helmet according to the subject disclosure.

After the external impact 180 is removed, the stored energy will return the shock absorption system 130 to the default state. In other words, the leaf spring 132 reverts from the deformed state and the middle portion 138 returns to the predetermined curvature. In addition, the convex surface of the middle portion 138 pushes outward against the inner surface of the outer shell 110 to return the outer shell 110 to the default state. Simultaneously, the first and second portions 134, 138 retract from the first and second recesses 156, 164 respectively. Furthermore, the compression spring 142 applies force against the flange 140 until no longer in a compressed state.

Figure 8:
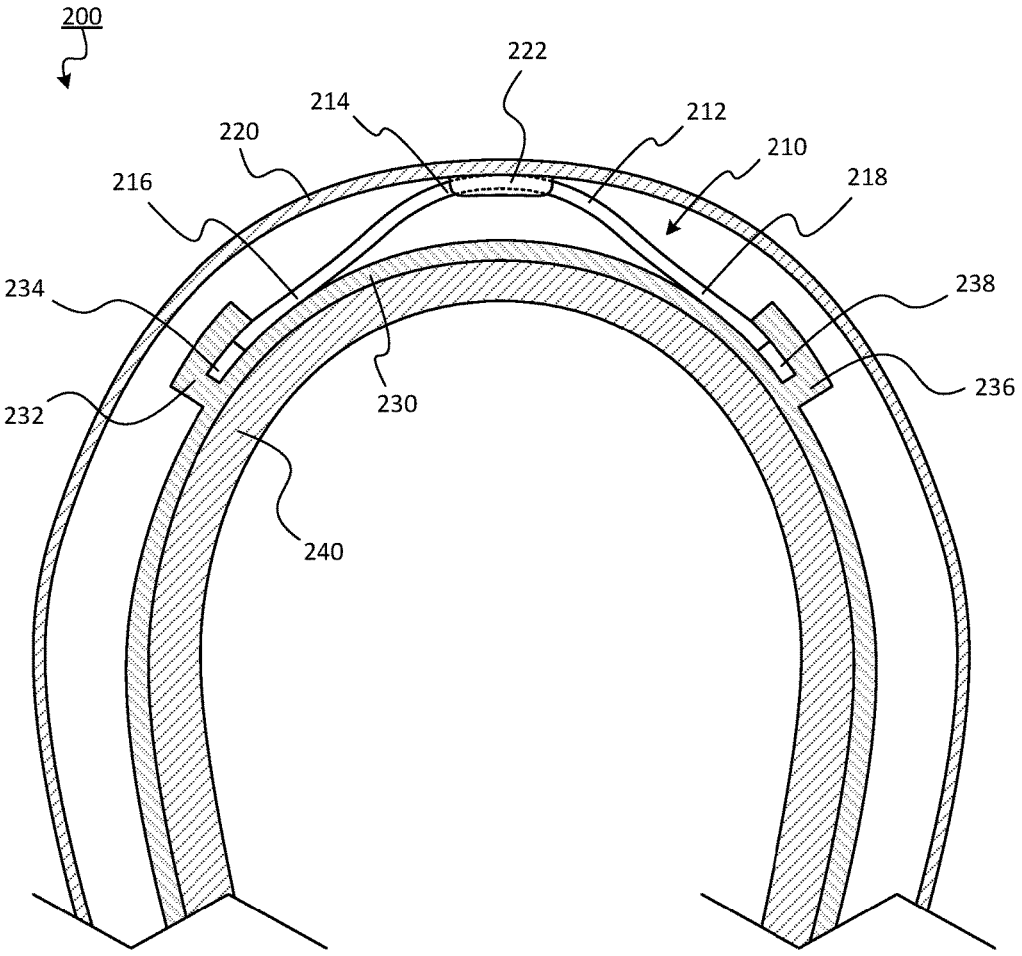
FIG. 8 depicts a front cross section view of another exemplary football helmet according to the subject disclosure.

FIG. 8 shows a further embodiment of an exemplary football helmet 200, in which a shock absorption system 210 having a leaf spring 212 is provided at an apex of the football helmet 200. Such an arrangement provides further shock absorption against head-on collisions. The football helmet 200 includes similar structure and features as the football helmet 100, such as an outer shell 220, inner shell 230, and padding 240.

Similar to the leaf spring 132, the leaf spring 212 comprises a curved middle portion 214, a first end portion 216, and a second end portion 218. The curved middle portion 214 has a predetermined curvature with a convex surface that abuts an inner surface of the outer shell 220. At the apex of the football helmet 200, a guide 222 is provided on the inner surface of the outer shell 220. The guide 222 sandwiches front and back flat surfaces of the leaf spring 212 and provides further structure and prevents the curved middle portion 214 from moving normal to the front and back flat surfaces. Furthermore, the first and second end portions 216, 218 may include a second curvature which is generally concentric to the inner shell 230. It is to be understood that the guide 222 is not shown in cross section for ease of illustration.

The inner shell 230 includes a first projection 232 having a first recess 234 and a second projection 236 having a second recess 238. The first and second recesses 234, 238 slidingly receive the first and second end portions 216, 218 of the leaf spring 212, respectively. The first and second recesses 234, 238 extend into the first and second projections 232, 236 in a direction tangential to the inner shell 150. As such, the first and second end portions 216, 218 slide tangentially to the inner shell 150 into and out of the first and second recesses 234, 238, respectively.

Thus, upon a head-on impact, the shock absorption system 210 dissipates impact energy by deforming the leaf spring 212, which extends into the first and second recesses 234, 238. When the first and second end portions 216, 218 completely extend into the first and second recesses 234, 238, respectively, the leaf spring 212 dissipates the force from the impact outward against the first and second recesses 234, 238 in a direction tangential to the inner shell 230.

It is to be understood that combinations of the features of football helmets 100, 200 are contemplated within the subject disclosure. For example, a guide similar to guide 222 may be provided to the leaf spring 132 in order to provide additional support and prevent lateral slippage of the middle portion 136. In a further example, a football helmet may comprise both shock absorption systems 130 and 210. In another further example, a projection of the inner shell may comprise two opposing extending recesses to accommodate multiple leaf springs, such as the first recess 156 and the second recess 238.

Figure 9:
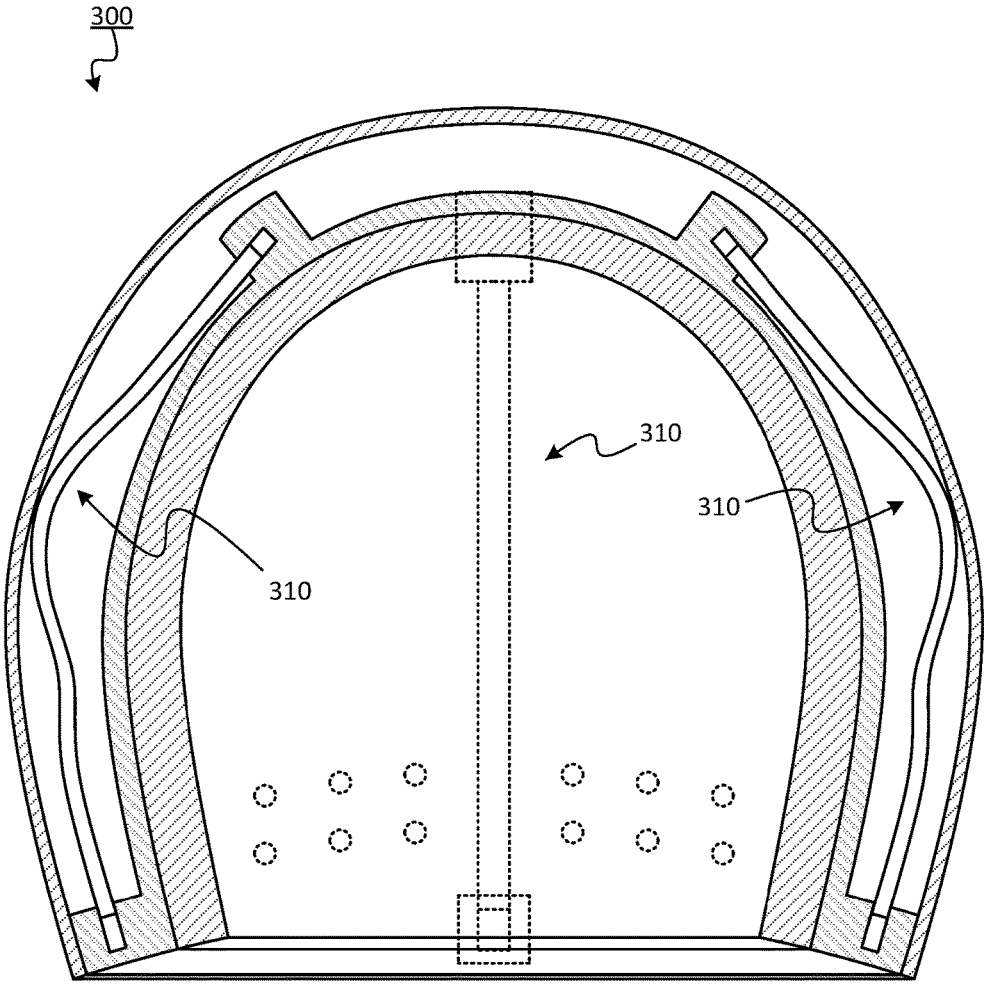
FIG. 9 illustrates a front cross section view of a further exemplary football helmet according to the subject disclosure.

FIG. 9 depicts a further embodiment of an exemplary football helmet 300 having shock absorption systems 310 without a compression spring and flange.

Figure 10:
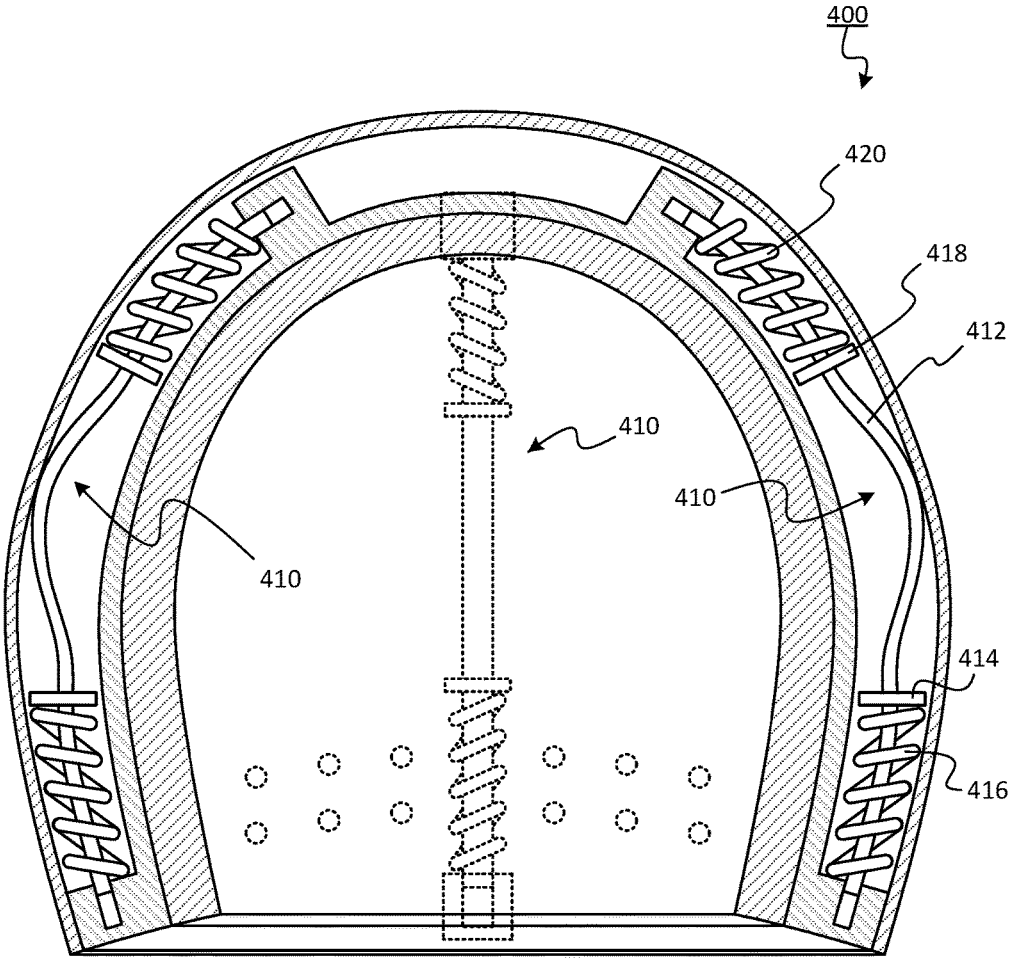
FIG. 10 illustrates a front cross section view of another further exemplary football helmet according to the subject disclosure.

FIG. 10 illustrates another further embodiment of an exemplary football helmet 400 having multiple compression springs for each leaf spring. For example, a shock absorption system 410 comprises a leaf spring 412 having a first flange 414 abutting against a first compression spring 416 and a second flange 418 abutting against a second compression spring 420.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed is:

1. A helmet for absorbing shock from impacts, the helmet comprising:
- an inner shell comprising:
  - an exterior surface that faces towards an outer shell;
  - an interior surface that faces towards an interior of the helmet; and
  - a first projection and a second projection, each protruding from the exterior surface of the inner shell in a direction towards the outer shell;
- the outer shell coupled to the inner shell, the outer shell comprising:
  - an exterior surface facing towards an exterior of the helmet; and
  - an interior surface that faces towards the inner shell; and
- at least one shock absorption system disposed between the inner shell and the outer shell, each shock absorption system comprising:
  - a first recess disposed within the first projection protruding from the exterior surface of the inner shell, the first recess having a first opening and a first inner wall, the first recess extending from the first opening to the first inner wall tangentially to a curvature of the inner shell;
  - a second recess disposed within the second projection protruding from the exterior surface of the inner shell, the second recess having a second opening and a second inner wall, the second recess extending from the second opening to the second inner wall tangentially to a curvature of the inner shell; and
  - a leaf spring having a first leg, a second leg, and a curved middle portion,
    - the first leg of the leaf spring being received by the first recess disposed within the first projection protruding from the exterior surface of the inner shell,
    - the second leg of the leaf spring being received by the second recess disposed within the second projection protruding from the exterior surface of the inner shell,
    - in a default state of the shock absorption system, a first gap is provided between the first leg of the leaf spring and the first inner wall, and a second gap is provided between the second leg of the leaf spring and the second inner wall, and
    - the leaf spring adapted to absorb shock from an external impact to the helmet by flexing and extending into the first recess of the first projection protruding from the inner shell and the second recess of the second projection protruding from the inner shell.

2. The helmet as recited in claim 1, wherein the inner shell is composed of a synthetic fiber.

3. The helmet as recited in claim 1, wherein the outer shell is composed of carbon fiber.

4. The helmet as recited in claim 1, wherein the first leg of the leaf spring abuts against the first inner wall and the second leg of the leaf spring abuts against the second inner wall in an active state of the shock absorption system.

5. The helmet as recited in claim 1, wherein the shock absorption system further comprises a compression spring helically coupled around the second leg of the leaf spring, the compression spring being disposed between a flange on the leaf spring and the second projection protruding from the inner shell.

6. The helmet as recited in claim 1, wherein the outer shell has air vents in fluid communication between an external environment and an internal air space disposed between the inner and outer shells, the internal air space providing an air cushion upon impact to the helmet.

7. The helmet as recited in claim 1, wherein the outer shell is replaceable.

8. A helmet for absorbing shock from impacts, the helmet comprising: an inner shell comprising: an exterior surface that faces towards an outer shell; an interior surface that faces towards an interior of the helmet; and a first projection and a second projection, each protruding from the exterior surface of the inner shell in a direction towards the outer shell; the outer shell coupled to the inner shell, the outer shell comprising: an exterior surface facing towards an exterior of the helmet; and an interior surface that faces towards the inner shell; and at least one shock absorption system comprising disposed between the inner shell and the outer shell, each shock absorption system comprising: a leaf spring having a first portion, a second portion, a curved middle portion, and a flange separating two portions of the leaf spring; a first recess extending into the first projection protruding from the exterior surface of the inner shell, the first recess receiving the first portion of the leaf spring, wherein, in a default state of the shock absorption system, a gap is provided in the first recess where it receives the first portion of the leaf spring; a second recess extending into the second projection protruding from the exterior surface of the inner shell, the second recess receiving the second portion of the leaf spring; and a compression spring coupled to the leaf spring, the compression spring disposed between the flange of the leaf spring and the second projection protruding from the exterior surface of the shell.

9. The helmet of claim 8, wherein the compression spring is concentrically disposed around the second portion of the leaf spring.

10. The helmet of claim 8, wherein a center axis of the compression spring is tangential to a curvature of the inner shell.

11. The helmet of claim 8, wherein the flange extends radially outward from the second portion of the leaf spring.

12. The helmet of claim 8, wherein the first portion of the leaf spring is adapted to linearly slide into and out of the first recess extending into the first projection protruding from the exterior surface of the inner shell in a direction tangential to the inner shell upon an external impact to the helmet.

13. The helmet of claim 8, wherein the second portion of the leaf spring is adapted to linearly slide into and out of the second recess extending into the second projection protruding from the exterior surface of the inner shell in a direction tangential to the inner shell upon an external impact to the helmet.

14. The helmet of claim 8, wherein the outer shell is replaceable.

15. The helmet of claim 8, further comprising padding disposed on the interior surface of the inner shell.

16. The helmet of claim 8, wherein the shock absorption system further comprises a second compression spring coupled to the leaf spring, the second compression spring disposed between a second flange of the leaf spring and the first projection protruding from the exterior surface of the inner shell.

17. The helmet of claim 8, further comprising a guide on the interior surface of the outer shell, the guide coupled to the curved middle portion of the leaf spring to prevent lateral slippage.

18. The helmet of claim 8, wherein the outer shell further comprises at least one air vent in fluid communication between an external environment to the helmet and an internal air space disposed between the inner shell and the outer shell.

19. The helmet of claim 8, wherein the inner shell is composed of a synthetic fiber.

* * * * *